US008036552B2

(12) United States Patent
Hashimoto

(10) Patent No.: US 8,036,552 B2
(45) Date of Patent: Oct. 11, 2011

(54) METHOD FOR CORRECTING REGISTRATION ERRORS BY SUPERIMPOSING A BLACK DEVELOPER ON A BACKGROUND OF A COLOR

(75) Inventor: Tomohiro Hashimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 344 days.

(21) Appl. No.: 12/233,971

(22) Filed: Sep. 19, 2008

(65) Prior Publication Data

US 2009/0080915 A1 Mar. 26, 2009

(30) Foreign Application Priority Data

Sep. 21, 2007 (JP) ..... 2007-245538
Sep. 3, 2008 (JP) ..... 2008-225813

(51) Int. Cl.
*G03G 15/00* (2006.01)

(52) U.S. Cl. ..... 399/49; 399/301

(58) Field of Classification Search ..... 399/49, 399/301

See application file for complete search history.

(56) References Cited

U.S. PATENT DOCUMENTS

| | | | | |
|---|---|---|---|---|
| 2002/0054200 | A1 | 5/2002 | Hayakawa | |
| 2004/0037584 | A1 | 2/2004 | Takahashi | |
| 2005/0200689 | A1 * | 9/2005 | Shinohara et al. | 347/116 |
| 2007/0110485 | A1 * | 5/2007 | Katsuhara et al. | 399/301 |

FOREIGN PATENT DOCUMENTS

| | | | |
|---|---|---|---|
| JP | 2002-023445 | A | 1/2002 |
| JP | 2004-102276 | A | 4/2004 |
| JP | 2007-079605 | A | 3/2007 |
| JP | 2007-240592 | A | 9/2007 |

* cited by examiner

*Primary Examiner* — David Gray
*Assistant Examiner* — G. M. Hyder
(74) *Attorney, Agent, or Firm* — Canon USA Inc. IP Division

(57) ABSTRACT

A color image forming apparatus causes a light emitting unit to emit light to a superimposed pattern in which a black developer (Bk) is superimposed on a color developer (Y, M, C) as a background color, detects diffuse reflected light by a light receiving unit, calculates positional deviation among the colors using the black developer (Bk) as a reference color based on a detection result, and adjusts an image forming condition.

12 Claims, 15 Drawing Sheets

METHOD FOR CORRECTING REGISTRATION ERRORS BY SUPERIMPOSING A BLACK DEVELOPER ON A BACKGROUND OF A COLOR

BACKGROUND OF THE INVENTION

1. Field of the Invention

The present invention relates to an arrangement for correcting misregistration (color misregistration) among the respective colors in an electrophotographic color image forming apparatus.

2. Description of the Related Art

Conventionally, color image forming apparatuses having independent image carriers are designed so that images of all the colors are superimposed without any deviation. However, since it is very difficult to completely eliminate variations in parts and those arising during assembly, adjusting of misregistration is necessary. One known example of such an adjustment method, as discussed in Japanese Patent Application Laid-Open No. 2002-023445, is to form a pattern for detecting misregistration, detect the position of the formed pattern, and correct a deviation amount.

In Japanese Patent Application Laid-Open No. 2002-023445, black is used as a reference color, and a pattern detection unit for detecting a pattern is configured so as to receive a specular-reflection component of light irradiated from a light emitting unit with a light receiving unit. Then, measurement color is sandwiched by the reference color, and an amount of positional deviation is calculated from a deviation amount in a result of comparison of center positions of the two reference color patterns sandwiching the measurement color and a center position of the measurement color pattern. From the calculation result, a misregistration amount among the respective colors can be corrected by adjusting image forming conditions, such as write timing of an image and an image clock.

An example of a technique for reducing a cost of a color image forming apparatus is to provide a polygonal mirror in a scanner unit to reflect light from a plurality of laser diodes for scanning. Further, a configuration which decreases a number of sensors for detecting a beam for generating a horizontal synchronizing signal is known. When the number of sensors for generating the horizontal synchronizing signal is decreased, it is known to use a pseudo-generated horizontal synchronizing signal (pseudo beam detection (BD) signal) for image formation of the colors which do not have a sensor. For example, Japanese Patent Application Laid-Open No. 2004-102276 discusses such a configuration.

In the configuration which decreases the number of sensors for beam detection for generating the horizontal synchronizing signal, how the sensors are arranged corresponding to the colors is important. In color image forming apparatuses which have a monochrome print mode (black-only printing) and a full color mode, images output in the monochrome print mode are often documents, so that quality of printed characters is important and demanded by users. An error amount of the pseudo BD signal is accumulated depending on the accuracy of calculation, sampling etc. at the time of its generation. Namely, the accumulation of error causes variation in a write position of a main scanning direction, and as a result, a problem of "jitter" is produced. Therefore, it is desirable to use a most accurately formed horizontal synchronizing signal (BD signal) for black printing synchronization. Further, it is desirable to use accurately formed black (Bk) as a reference color for registration correction.

Recently, in order to reduce costs even further, as a technique for utilizing a low-cost intermediate transfer member, a method has been discussed in which a light receiving unit receives diffuse reflected light which is independent of a surface state of the intermediate transfer member to perform registration correction.

However, when, for example as described above, black is used for the reference color to employ the sensor output for beam detection provided for black as the BD signal, and a pseudo BD signal is used for the other colors, the black pattern cannot be detected even if diffuse reflected light is employed. This is because black is a developer that shows only a small reflected component in the diffuse reflected light. If the black pattern cannot be read, the registration correction cannot be carried out.

On the other hand, recently, for color image forming apparatuses, there is a need for further miniaturization of apparatus or a need for more efficient registration correction to reduce toner consumption resulting from the registration correction.

SUMMARY OF THE INVENTION

According to an aspect of the present invention, a color image forming apparatus includes a forming unit configured to form an image on an image carrier using a color developer and a black developer, a transfer unit configured to transfer the image formed on the image carrier onto a transfer material, a fixing unit configured to fix the image transferred onto the transfer material by the transfer unit, a controller configured to form on the image carrier a superimposed pattern by the forming unit in which a pattern of the black developer is superimposed on a pattern of the color developer as a background color, a detector configured to irradiate the superimposed pattern with light and detect diffuse reflected light, a calculator configured to determine a position of the pattern of the color developer and a position of the pattern of the black developer based on a detection result of the diffuse reflected light from the superimposed pattern by the detector and calculate a deviation amount in relative positions between the pattern of the color developer and the pattern of the black developer, and an adjustor configured to adjust an image forming condition based on a calculation result by the calculator.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
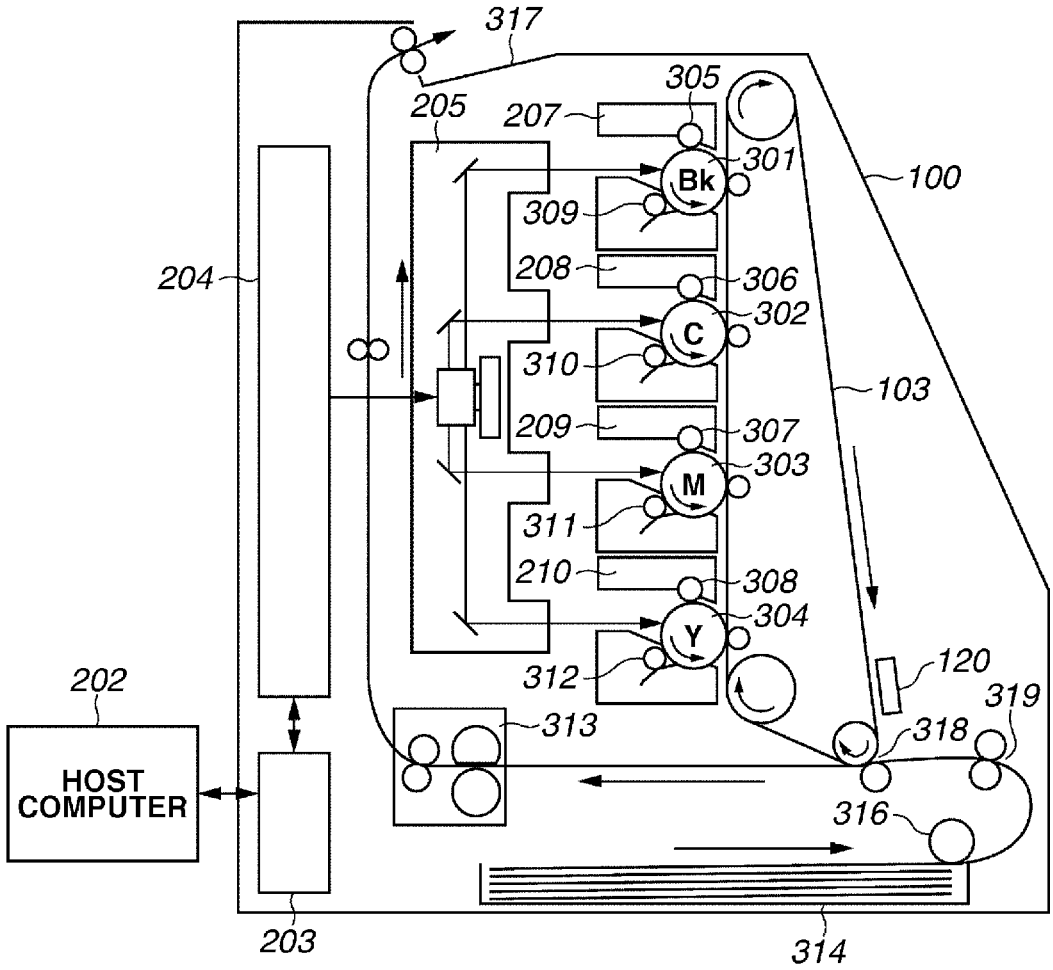
FIG. 1 is a diagram illustrating a configuration of a color image forming apparatus.

A first exemplary embodiment will be described as follows. FIG. 1 is a diagram illustrating a color image forming apparatus 100 which is connected to a host computer 202. The color image forming apparatus according to the present exemplary embodiment includes a four-color image forming unit for forming a color image in which images of a plurality of colors (yellow: Y, magenta: M, cyan: C, black: B) are superimposed. While a four-color image forming apparatus is described below, the present invention may be applied to already-known color image forming apparatuses using a plurality of various colors, such as six colors.

The image forming apparatus 100 includes process cartridges 207 to 210 which have a photosensitive drum 301 to 304 respectively and a scanner unit 205 which has a laser diode for generating a laser beam as a light source for image exposure.

When print data is received from the host computer 202, the print data received by a video controller 203 in the color image forming apparatus 100 is rasterized into desired video signal forming data (e.g., bitmap data) and a video signal for image forming is generated. The video controller 203 and an engine controller 204 send and receive information by serial communication with each other. By this communication of the information, the video signal is sent to the engine controller 204. The engine controller 204 drives a laser diode (not shown) in the scanner unit 205 in response to the video signal, and forms an electrostatic latent image on the photosensitive drums 301 to 304 within the process cartridges 207 to 210 which have been charged by charging units 305 to 308. The engine controller 204 also functions as a controller for forming a pattern illustrated in the FIG. 4 as described below by using the process cartridges 207 to 210 which function as a forming unit. The photosensitive drums 301 to 304 are respectively utilized in forming a black electrostatic latent image (photosensitive drum 301), a cyan electrostatic latent image (photosensitive drum 302), a magenta electrostatic latent image (photosensitive drum 303), and a yellow electrostatic latent image (photosensitive drum 304).

The electrostatic latent images formed on the photosensitive drums 301 to 304 are visualized at positions of developing rollers 309 to 312 by a process unit housed within each of the process cartridges 207 to 210 to form a toner image on the photosensitive drums 301 to 304. While the process unit includes a charge roller, a developing roller, a cleaning roller, and the like, a detailed description thereof is omitted here. Among the toner images in each color formed on the photosensitive drums 301 to 304, first, the yellow (Y) image is transferred onto an intermediate transfer member 103 which is an image carrier, and then magenta (M), cyan (C), and black (Bk) images are successively transferred in this order. By the above-described sequential transfer of the toner images, a multicolor image is formed on the intermediate transfer member 103 (on the image carrier).

A transfer material in a cassette 314 is supplied by a paper feeding roller 316 up to a registration roller 319, and then the transfer material is conveyed in synchronization with the image on the intermediate transfer member 103 at drive timing of the registration roller 319. Then, the multicolor image is transferred onto the transfer material from the intermediate transfer member 103 by a transfer roller 318. The image which is transferred onto the transfer material is fixed with heat and pressure by a fixing unit 313. Then, the transfer material is output onto an output tray 317.

A pattern detection sensor 120 for color misregistration detection detects the pattern formed on the intermediate transfer member 103. The pattern detection sensor 120 reads the position of the image of each color formed on the intermediate transfer member 103 at desired timing except when forming the image, and sends the read data as feedback to the video controller 203 or engine controller 204 for adjustment of the image registration position of each color. As a result, color misregistration can be prevented while usability is ensured.

Figure 2:
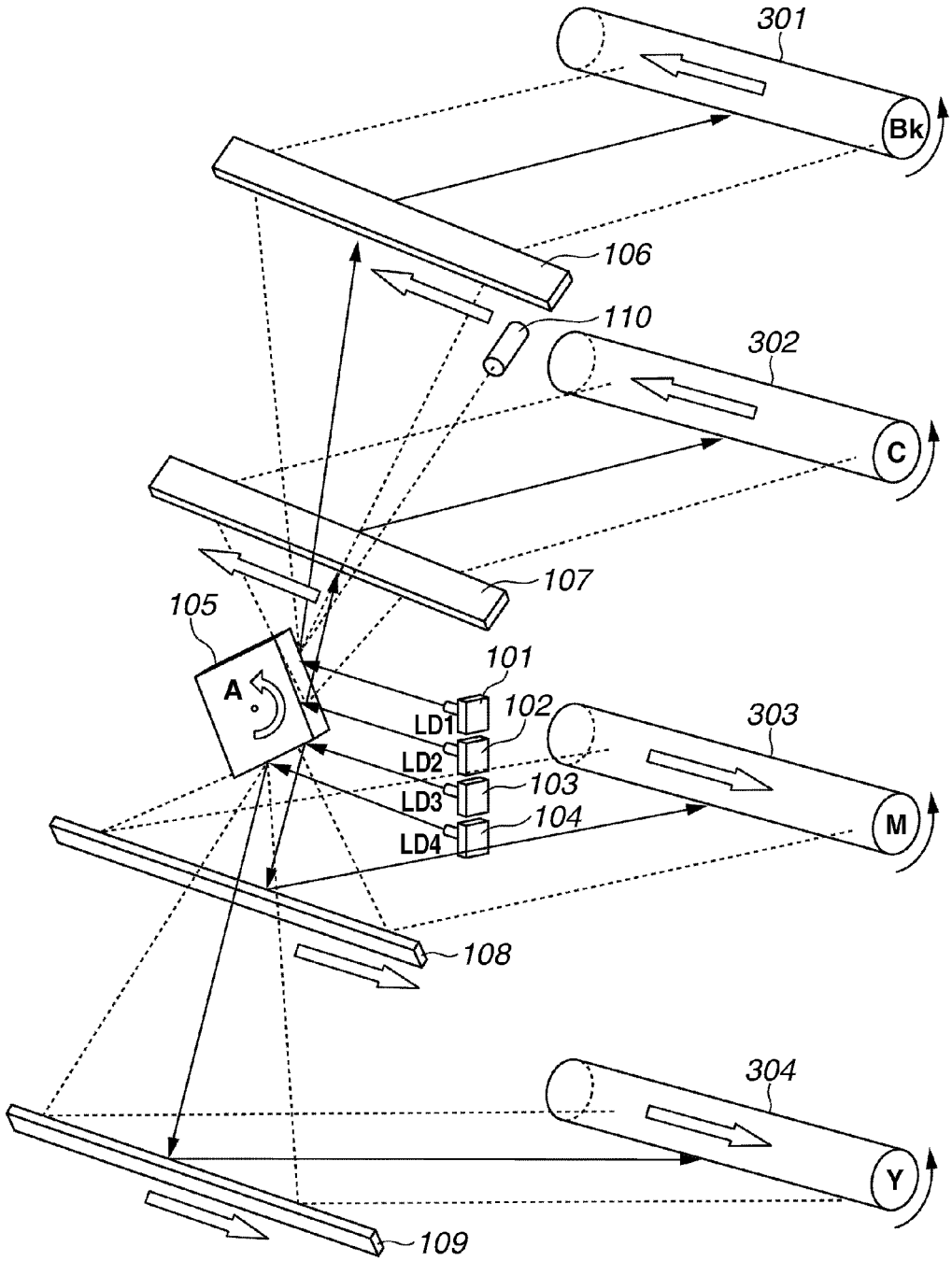
FIG. 2 is a diagram illustrating a configuration of a scanner unit.

Next, the configuration of the scanner unit 205 will be described using FIG. 2. The scanner unit 205 includes a first laser diode 101 (LD1), a second laser diode 102 (LD2), a third laser diode 103 (LD3), and a fourth laser diode 104 (LD4) which generate a laser beam for scanning each of the photosensitive drums 301 to 304 based on the video signal generated by the engine controller 204. A polygon mirror 105, which is rotated by a motor (not shown) at a fixed speed in the direction of arrow A in FIG. 2, reflects the laser beams from the laser diodes LD1, LD2, LD3, and LD4 for scanning. The motor for driving the polygon mirror 105 is controlled to rotate at the fixed speed by an acceleration signal and a deceleration signal of speed control signals from the engine controller 204. The scanner unit 205 also includes reflection plates 106 to 109 for leading the laser beams from the laser diodes LD1, LD2, LD3, and LD4 which are reflected by the polygon mirror 105 to the photosensitive drums 301 to 304. A BD sensor 110 which is a light sensor for generating a horizontal synchronizing signal generates a signal when a laser beam is incident thereon and is located on the scanning path of the laser diode LD1. In the present exemplary embodiment, the BD sensor 110 is only arranged on the scanning path of the black laser diode LD1, and is not present on the scanning paths of the other laser diodes. The BD sensor 110 is only arranged on the scanning path of the black laser diode LD1 so as to prevent deterioration of quality of printed characters in an only-black printed matter which is most frequently used by users.

The laser beam generated from the laser diode LD1 is reflected by the polygon mirror 105, shifts a traveling direction by a rotation of the polygon mirror 105, and is further reflected by a folding mirror 106 and scans the photosensitive drum 301 in a direction from left to right (main scanning direction). In practice, the laser beams pass through various lens groups (not shown) in order to adjust focal points on the photosensitive drums, or to convert the laser beams from diffuse light into parallel light.

Generally, the video controller 203 sends a video signal to the engine controller 204 after a certain amount of time has elapsed since an output signal from the BD sensor 110 was detected. As a result, main scan of the image by the laser beam always coincides in its write positions on the photosensitive drum.

On the other hand, similar to the laser diode LD1, the laser diodes LD2, LD3, and LD4 also form an electrostatic latent image on the respective photosensitive drums 302 to 304. Concerning the position detection of the laser beams, since the BD sensor is not present on the scanning paths of the laser diodes 102 to 104, the horizontal synchronization has to be obtained in some other way. When the BD sensor is not present on all stations, a pseudo BD signal or the horizontal synchronizing signal adjusted to predetermined time is generated by the video controller 203 based on the BD signal or horizontal synchronizing signal which is output from the BD sensor of a station which has the BD sensor. More specifically, for the LD2 which scans the same face as the LD1 that has the BD sensor, the horizontal synchronizing signal is generated with the same timing as the LD1. Further, for the LD3 and LD4 which always scan a face different to that of the LD1 which has the BD sensor, generally the horizontal synchronizing signal is generated with timing that has been corrected by an amount of face jitter of the polygon mirror 105. In the following description, among the laser diodes that do not have the BD sensor, the horizontal synchronizing signal used for the laser diodes LD3 and LD4 that scan a face of the scanningpolygon mirror 105 which is different to that of the laser diode LD1, is referred to as a "pseudo BD signal".

Thus, a black (Bk) image is formed on the photosensitive drum 301 by the laser diode LD1 having the BD sensor 110. Further, the yellow (Y), magenta (M), and cyan (C) color images are formed on the photosensitive drums 302 to 304, respectively, by the laser diodes LD2, LD3, and LD4 which do not have the BD sensor 110.

The color image forming apparatus 100 in the present exemplary embodiment has a monochrome print mode which performs image formation only with a black developer, and a full color print mode which forms a multicolor image by superimposing a plurality of developers (color developers and a black developer). The monochrome print mode especially is often used for the printing of business documents etc., so that emphasis is placed on the quality of the printed characters. On the other hand, the full color print mode is used in printing photo images etc., so that emphasis is placed on color reproducibility. To increase the color reproducibility, accuracy with which the plurality of developers are superimposed (color misregistration accuracy) is important.

Figure 3:
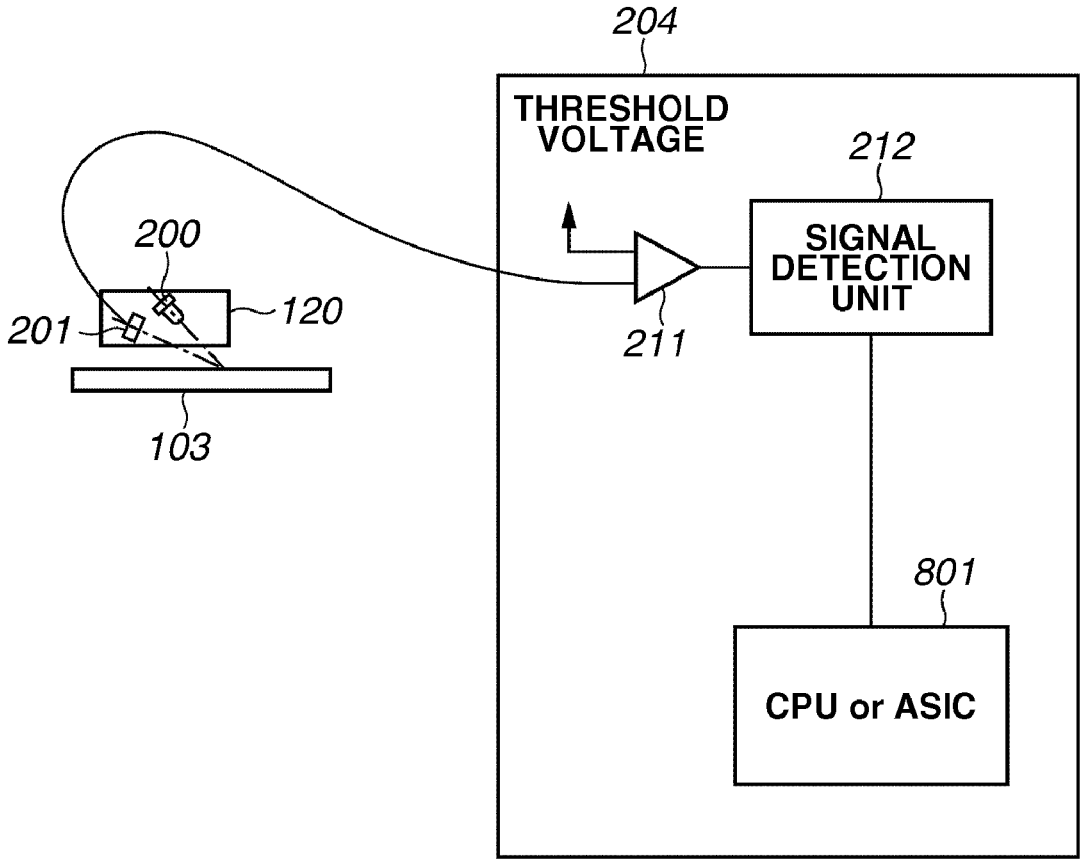
FIG. 3 is a diagram illustrating one example of a detection circuit of a color misregistration amount detection pattern.

FIG. 3 illustrates one example of a circuit for detecting a color misregistration amount detection pattern. Here, the term "color misregistration amount" means a misregistration amount among the respective colors. "Color misregistration amount detection pattern" may also be referred to as "misregistration amount detection pattern". In the following description, the term "color misregistration amount" will be used. The pattern detection sensor 120 (sensor 120) includes a light emitting unit 200 (e.g., an LED etc.), and a light receiving unit 201 (e.g., a phototransistor etc.). Light emitted (irradiated) from the light emitting unit 200 is diffused and reflected by the intermediate transfer member 103, and the diffuse reflected light is detected by the light receiving unit 201. The light receiving unit 201 performs an I-V conversion on the detected light, and transmits the signal to a comparator 211 which is in the engine controller 204. At the comparator 211, the analog signal transmitted from the light receiving unit 201 is binarized based on a predetermined threshold voltage, and the binarized signal is transmitted to a signal detection unit 212. The signal detection unit 212 is configured, like a central processing unit (CPU) or an application specific integrated circuit (ASIC), by a unit having a function capable loading and storing the signals in a time-series order. An output of the signal detection unit 212 is loaded into a controller 801, such as a CPU, and is utilized as data for misregistration detection.

Next, the configuration of one set of color misregistration amount detection patterns, the color misregistration amount detection patterns formed on the intermediate transfer member 103 when performing color misregistration correction control, and a method for correcting the color misregistration in the present exemplary embodiment will be described in that order.

Figure 4:
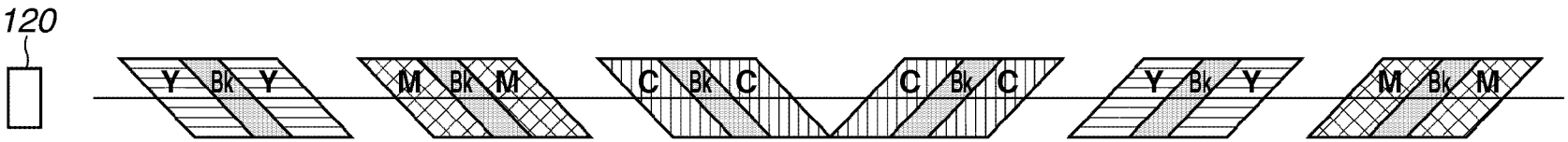
FIG. 4 is a diagram illustrating one example of a color misregistration amount detection pattern.

FIG. 4 illustrates a configuration example of one set of color misregistration amount detection patterns formed by a control of the engine controller 204. Each of the color misregistration amount detection patterns of FIG. 4 is a parallelogram. By determining how much a color misregistration detection pattern deviates from the position where it should be placed, each color misregistration in the main scanning direction and sub-scanning direction can be calculated. A width in the moving direction of first developer patterns (Y, M, and C) is longer than the width in the moving direction of a second developer pattern (Bk). A maximum deviation amount between the positions of the reference color (Bk) and a measurement color (Y, M, and C) is assumed and when the maximum deviation occurs, the width of the measurement color in a moving direction is shortened. Even under such conditions, the width in the moving direction of the first developer patterns (Y, M, and C) is set to be long in order to ensure that the pattern width is appropriate for sensor reading performance. As a result, reliable registration correction can be realized.

Figures 5A, 5B:
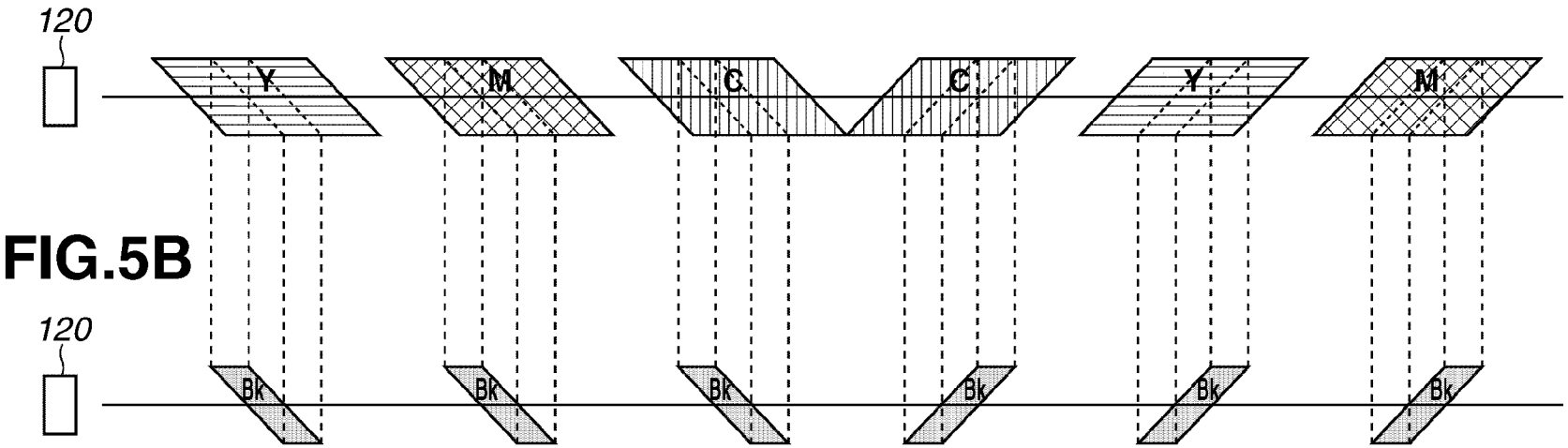
FIGS. 5A and 5B are diagrams illustrating one example of a color misregistration amount detection pattern classified by color.

In the color misregistration amount detection patterns illustrated in FIG. 4, the patterns of the measurement colors yellow (Y), magenta (M), and cyan (C) illustrated in FIG. 5A are used as a background color, and the pattern of the reference color black (Bk) illustrated in FIG. 5B is superimposed over the background color. Such a pattern is referred to as a "superimposed pattern". Further, in the present exemplary embodiment, the black developer is referred to as "second developer", because the black developer belongs to a category whose diffuse reflected light cannot be adequately detected (sensed) by the sensor 120. On the other hand, the yellow (Y) etc. developers are referred to as "first developer", because they belong to a category whose diffuse reflected light can be adequately detected (sensed) by the sensor 120. While the superimposed pattern is moving from left to right (or from right to left), the first developer, the second developer, and the first developer are passed in that order under the sensor 120 along the moving direction, and detection (sensing) of the superimposed pattern by the diffuse reflected light is performed.

Figure 6:
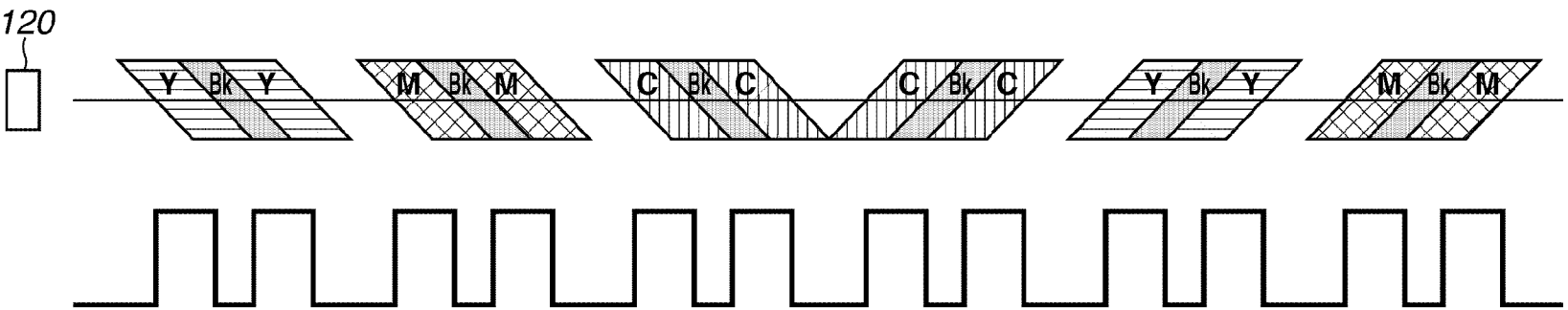
FIG. 6 is a diagram illustrating a detection waveform when a color misregistration amount detection pattern is detected.

FIG. 6 illustrates a detection waveform when the pattern illustrated in FIG. 4 is detected by the pattern detection sensor 120. A "LOW" level is indicated at portions where a surface of the intermediate transfer member 103 and the black (Bk) developer are present, since the amount of diffuse reflected light output (irradiated) from a light emitting unit of the pattern detection sensor 120 which is received by a light receiving unit is not enough to exceed a preset threshold. Further, a "HIGH" level is indicated at the portions where the yellow (Y), magenta (M), and cyan (C) developers are present, since the amount of diffuse reflected light output from the light emitting unit of the pattern detection sensor 120 which is received by the light receiving unit is enough to exceed the preset threshold.

Figure 7:
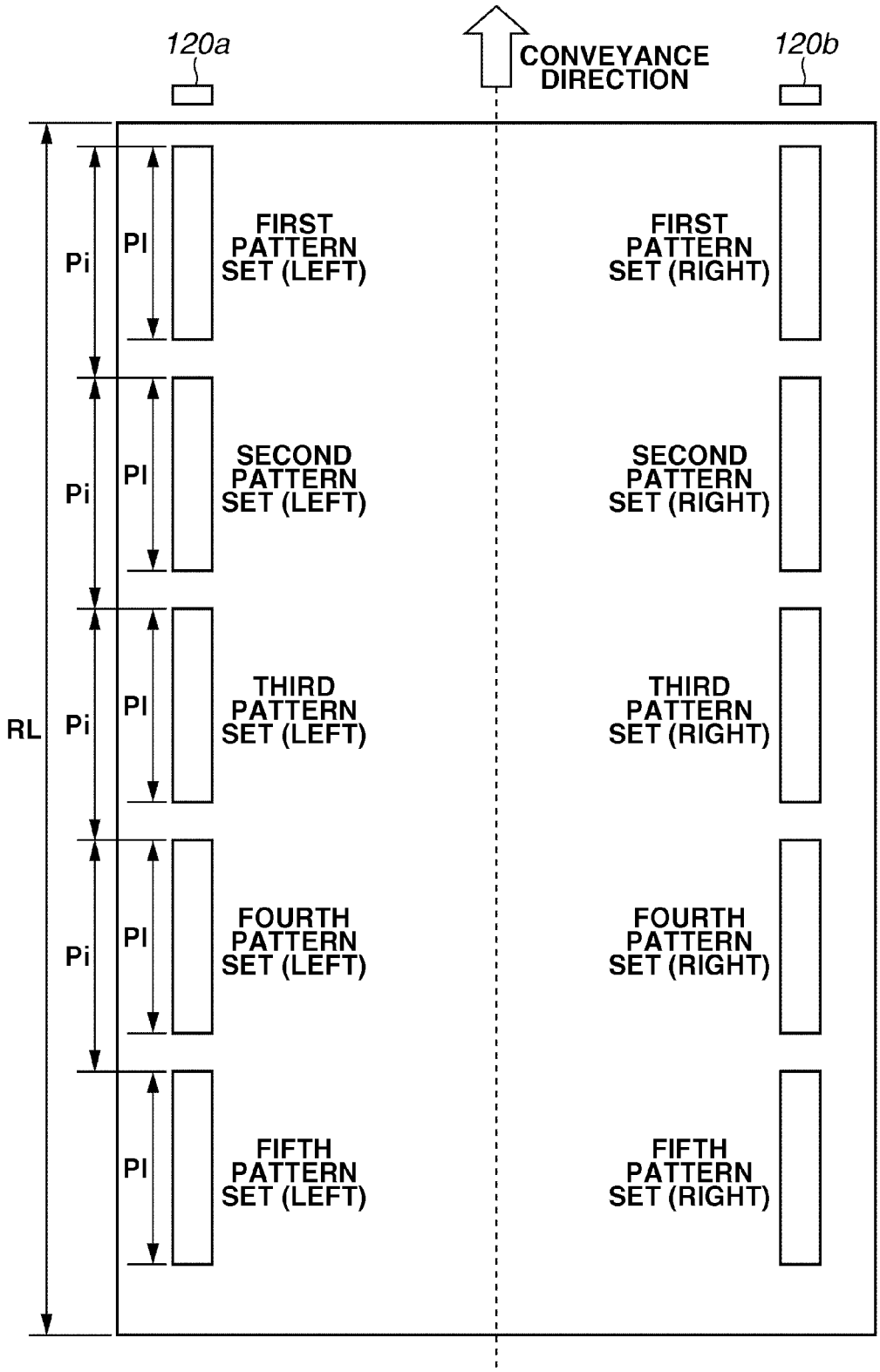
FIG. 7 is a diagram illustrating appearance of a color misregistration amount detection pattern formed on an intermediate transfer member (on an image carrier).
Figure 8:
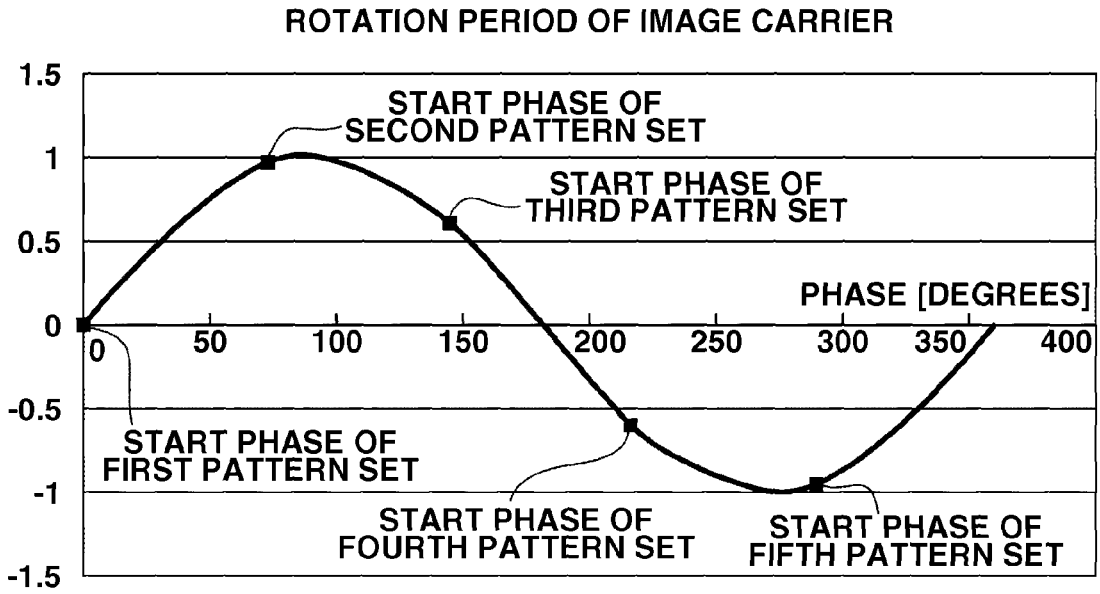
FIG. 8 is a diagram illustrating a relationship between a phase of the image carrier and write timing of the color misregistration amount detection pattern.

FIG. 7 illustrates one example of the color misregistration amount detection pattern formed on an endless intermediate transfer member 103 when the intermediate transfer member 103 is rasterized. Here, the example shows that five sets of the color misregistration detection patterns illustrated in FIG. 4 having a pattern length Pl per set are formed on a round length RL of the intermediate transfer member 103 at a pattern interval Pi. Each set of the color misregistration amount detection patterns has a write timing position whose phase deviates by 72 degrees over a rotation period T of the image carrier as illustrated in FIG. 8. At this stage, the following relationships are satisfied.

$$RL>4\times Pi+Pl$$

$$Pi>Pl$$

$Pi=N/5$ (wherein N represents a length of a belt of the intermediate transfer member 103)

When M sets of the color misregistration detection patterns are formed on the round length RL of the intermediate transfer member 103, if the conditions of $$RL>(M-1)\times Pi+Pl$$

$$Pi>Pl$$

$$Pi=N/M$$

are satisfied, the color misregistration correction control for one time can be completed by rotating the intermediate transfer member 103 once.

Next, a method for identifying the position of the image for each color and calculating the misregistration amount among the respective colors will be described using FIG. 9 based on detection results (sensing results) of the color misregistration amount detection patterns (superimposed patterns). The positions of the first developer (Y, M, and C) patterns and the position of the second developer (Bk) pattern are determined based on the detection results of the diffuse reflected light from the patterns produced by the first developers (Y, M, and C) contained in the superimposed pattern. In the following description, the calculation is performed by the controller 801 having a CPU or ASIC in the above-described FIG. 3.

In the method for calculating the misregistration amount of the measurement color with respect to the reference color from the results detected by the signal detection unit 212, the misregistration amount is determined from deviation amounts of the reference color (Bk) pattern and the measurement color (Y, M, or C) pattern from a center value. The method for calculating the deviation amounts of the reference color (Bk) pattern and a measurement color (Y, M, or C) pattern from the center value will be described based on FIG. 9.

Figure 9:
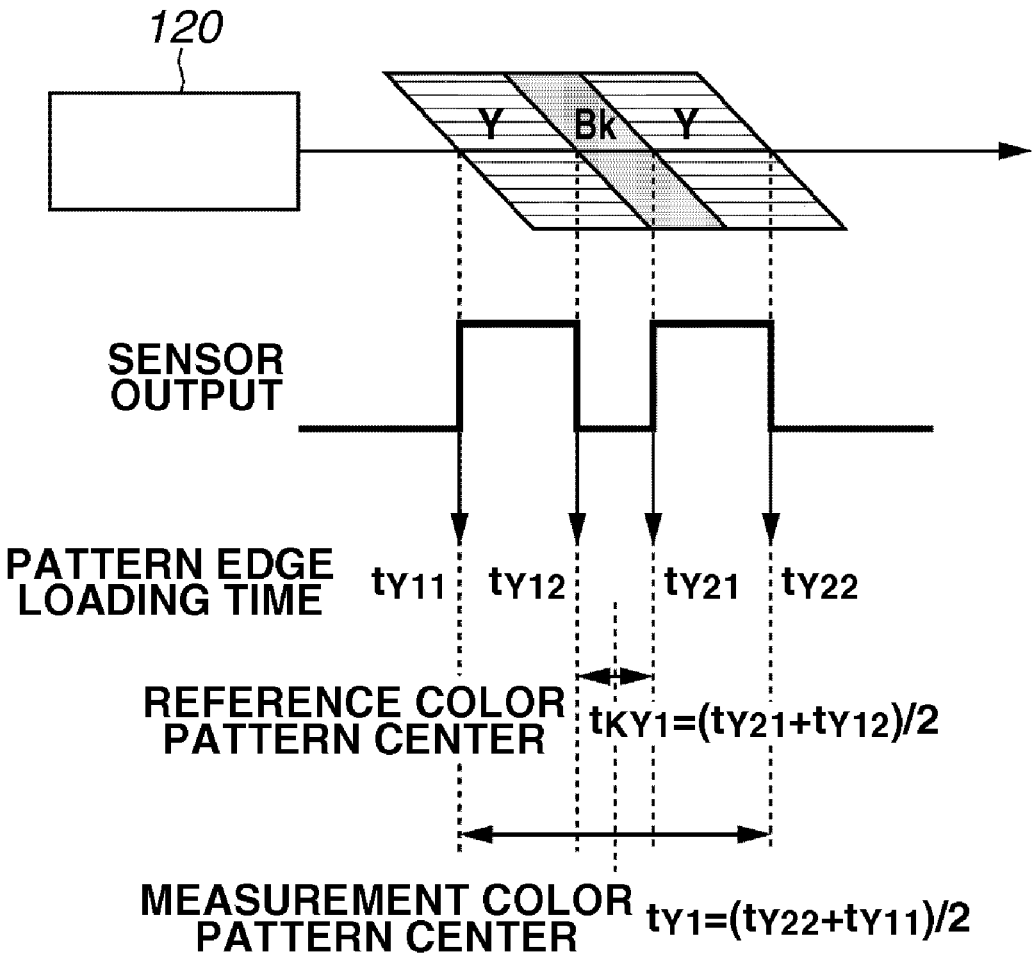
FIG. 9 is a diagram illustrating a method for calculating a deviation amount between a position of a measurement color of a first developer and a position of a reference color of a second developer.

FIG. 9 illustrates an example of the color misregistration amount detection pattern and a detection signal which is detected by the pattern detection sensor 120 and binarized by the comparator 211. When, as illustrated in FIG. 9, the times corresponding to rising and falling of the detection signal are represented as $t_{Y11}$, $t_{Y12}$, $t_{Y21}$, and $t_{Y22}$, the reference color center value $t_{KY1}$ and the measurement color center value $t_{Y1}$ can respectively be represented by following expressions. Here, "t" represents an elapsed time taken from a given reference (timer measurement start), and in the present exemplary embodiment, the elapsed time is converted into (made to correspond to) a distance to determine the position. In other words, the elapsed time is used to determine a temporal position. The given reference (timer measurement start) at this stage may be, for example, timing at which the pattern is initially detected in the below-described FIG. 10 ($t_{Y11}$ in FIG. 9), or may be timing prior to $t_{Y11}$ in FIG. 9. "The position of the pattern" collectively means a center position of the pattern and the position of an edge portion of the pattern. Further, $t_{Y11}$ represents detection start of the first developer, and $t_{Y22}$ represents detection finish of the first developer. The position of the pattern produced by the second developer (Bk) can be indirectly specified by detecting $t_{Y12}$ and $t_{Y21}$ which represent the detection start and detection finish of the first developer.

$$t_{Y1}=(t_{Y22}+t_{Y11})/2$$

$$t_{KY1}=(t_{Y21}+t_{Y12})/2$$

Figure 10:
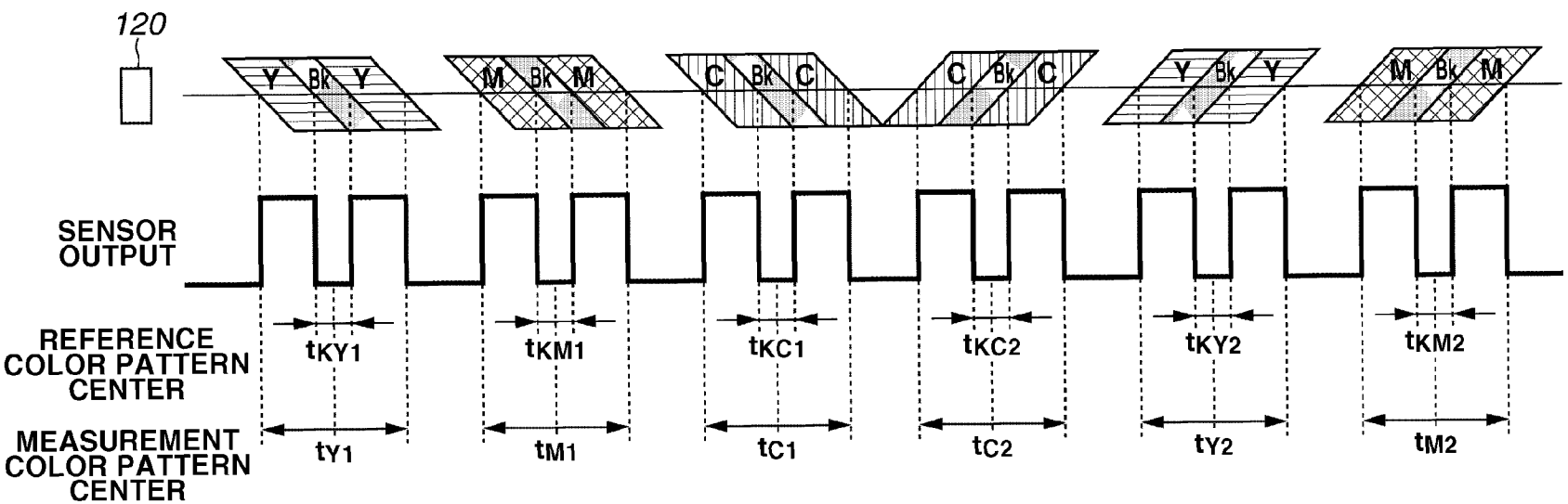
FIG. 10 is a diagram illustrating position detection of one set of color misregistration amount detection patterns.

Similarly, as illustrated in FIG. 10, the color misregistration amount which is the deviation amount in the relative positions between colors is calculated in the following manner by determining the center values of all the patterns in one set of the color misregistration amount detection patterns.

Color Misregistration in the Sub-scanning Direction

Sub-scanning color misregistration amount between $Bk$ and $Y=(t_{Y1}-t_{KY1}+t_{Y2}-t_{KY2})/2$ Sub-scanning color misregistration amount between $Bk$ and $M=(t_{M1}-t_{KM1}+t_{M2}-t_{KM2})/2$ Sub-scanning color misregistration amount between $Bk$ and $C=(t_{C1}-t_{KC1}+t_{C2}-t_{KC2})/2$ Color Misregistration in the Main Scanning Direction Main scanning color misregistration amount between $Bk$ and $Y=(t_{Y1}-t_{KY1}-t_{Y2}+t_{KY2})/2$ Main scanning color misregistration amount between $Bk$ and $M=(t_{M1}-t_{KM1}-t_{M2}+t_{KM2})/2$ Main scanning color misregistration amount between $Bk$ and $C=(t_{C1}-t_{KC1}-t_{C2}+t_{KC2})/2$ The color misregistration amounts of write positions in the sub-scanning and main scanning are calculated by performing the above calculation for each pattern set, and determining an average for all of the sets. By taking the average of the pattern sets whose write timing phase deviates, the color misregistration amount resulting from rotation unevenness of the image carrier can be averaged.

Further, total magnification color misregistration amount in the main scanning is calculated for each pattern set which is formed facing the left and right of the intermediate transfer member 103 illustrated in FIG. 7 based on the above main scanning color misregistration amounts.

Total Magnification Color Misregistration of n-th Set in the Main Scanning:

The total magnification color misregistration amount between Bk and Y of n-th set=n-th Set (right) main scanning color misregistration amount between Bk and Y−n-th set (left) main scanning color misregistration amount between Bk and Y The total magnification color misregistration amount between Bk and M of n-th set=n-th Set (right) main scanning color misregistration amount between Bk and M−n-th set (left) main scanning color misregistration amount between Bk and M The total magnification color misregistration amount between Bk and C of n-th set=n-th Set (right) main scanning color misregistration amount between Bk and C−n-th set (left) main scanning color misregistration amount between Bk and C Here, a positive calculation result indicates that the writing of the measurement color starts later than that of the reference color (the image width of the measurement color is wider than that of the reference color in terms of the total magnification). On the other hand, a negative calculation result indicates that the writing of the measurement color starts earlier than that of the reference color (the image width of the measurement color is narrower than that of the reference color in terms of the total magnification).

The color image forming apparatus 100 executes a color misregistration correction control, and then corrects an image forming condition which was determined prior to performing the color misregistration correction control. More specifically, the correction is performed by adding (or subtracting) the calculated deviation amount to settings of the main scanning write timing, sub-scanning write timing, and the total magnification in the main scanning as the image forming conditions. Thus, the image forming condition can be appropriately adjusted based on the calculation results relating to the color misregistration. The adjusted condition can be used as the setting from the next time. The adjustment of the image forming condition based on the calculated color misregistration amount can be performed by employing a well-known technique. Accordingly, a detailed description is not included.

Figure 15:
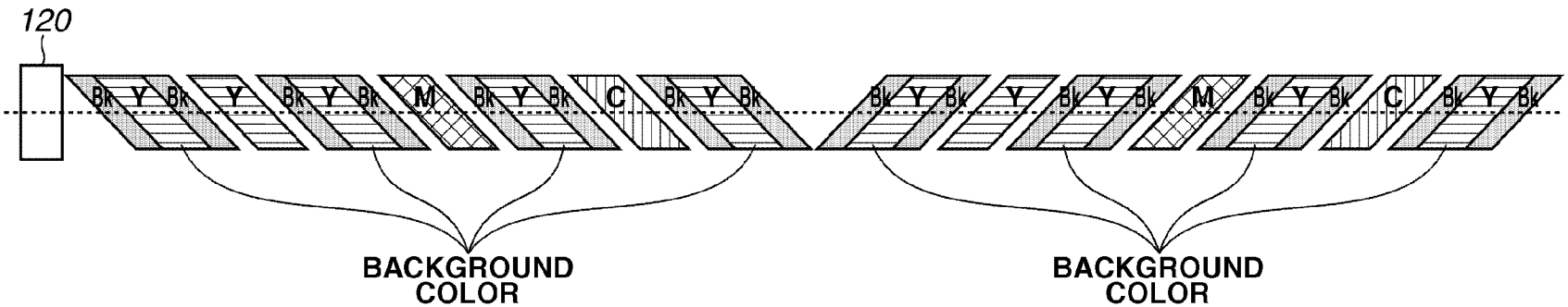
FIG. 15 is a diagram for describing an effect according to exemplary embodiments.

As described above, the color image forming apparatus which can receive the diffuse reflected light and efficiently perform the registration correction can be realized while using the developer color having a small reflected component in the diffuse reflected light, such as black. Additional effects will now be described. A color misregistration amount detection pattern like that in FIG. 15 is assumed. In the color misregistration amount detection pattern like that in FIG. 15, the reference color is black, and the measurement colors are yellow (Y), magenta (M), and cyan (C). The diffuse reflected light described above is detected by the detecting sensor 120. In this case, because no diffuse reflected light can be detected for black (Bk), the pattern is formed by superimposing black (Bk) on the background color of yellow (Y). As a result, the registration correction can be performed even in a mode in which the BD sensor is provided for black (Bk), a pseudo BD is employed for the other measurement colors, and the diffuse reflected light is detected. In this mode, the intermediate transfer belt can be made cheaper.

Here, as an additional effect, a total length of the pattern can be made shorter by employing the superimposed pattern illustrated in FIG. 4 for the superimposed pattern illustrated in FIG. 15. This additional effect will be described in detail. First, with respect to performance such as sensor response and resolution, the width required for detecting the measurement color (assuming that moving speed is of a certain speed) will be given as l, and the width required for detecting black (Bk) will be given as d. Then, the number of measurement colors in one set is set at 6 (in FIG. 15, Y, Y, Y, M, Y, C) so that registration accuracy has the same conditions.

Thus, in the pattern illustrated in FIG. 15, at least a length of (12 l+12 d) is required for one set of the superimposed patterns. On the other hand, for the pattern in FIG. 4, the required length is (12 l+6 d), so that the width required for the reference color black (Bk) is shortened and black (Bk) toner consumption can be reduced. This effect is useful when monochrome printing is mainly used in the color image forming apparatus.

The registration correction is required to reduce downtime, and it is desirable that all the patterns can be contained within one round of the intermediate transfer member (belt). Further, to maintain registration correction accuracy at a constant level, a fixed number of patterns have to be formed. In such a case, by employing the pattern illustrated in FIG. 4, the width of the color misregistration amount detection patterns per set can be shortened, and as a result, the length of the intermediate transfer member (belt) can be shortened while maintaining the registration correction accuracy at a constant level.

A second exemplary embodiment will be described using FIGS. 11 to 14. It is noted that the overall configuration of the color image forming apparatus used in the second exemplary embodiment is the same as that in the first exemplary embodiment, and thus a description thereof is not repeated. Here, the configuration of one set of the color misregistration amount detection patterns, the configuration of the color misregistration amount detection patterns formed on the intermediate transfer member 103 when performing the color misregistration correction control, and the method for correcting the color misregistration in the second exemplary embodiment will be described in that order.

Figure 11:
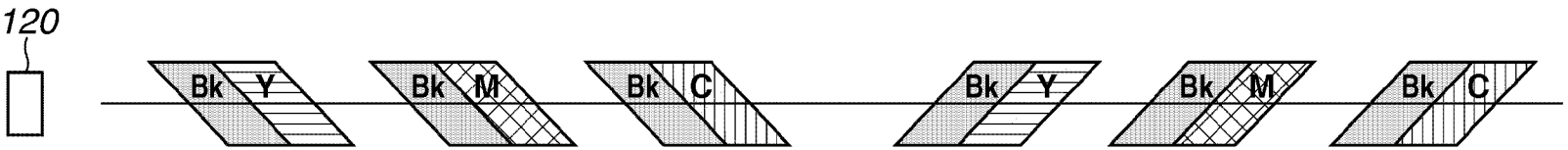
FIG. 11 is a diagram illustrating one example of a color misregistration amount detection pattern.
Figures 12A, 12B:
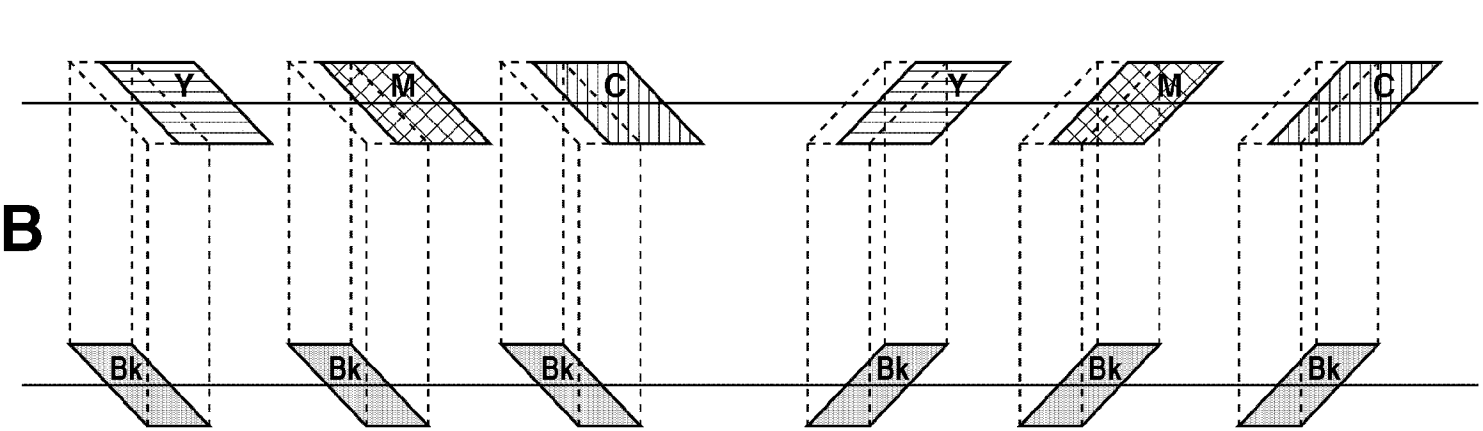
FIGS. 12A and 12B are diagrams illustrating one example of a color misregistration amount detection pattern classified by color.

FIG. 11 illustrates a configuration of one set of the color misregistration amount detection patterns in the second exemplary embodiment. The color misregistration amount detection patterns illustrated in FIG. 11 are, as illustrated in FIGS. 12A and 12B, made up of yellow (Y), magenta (M), and cyan (C) patterns having a black (Bk) pattern superimposed on one side thereof. The reference color pattern is superimposed on the patterns of the measurement colors which are wider than a predetermined pattern width so that the width of the measurement color patterns is a predetermined ideal width.

Figure 13:
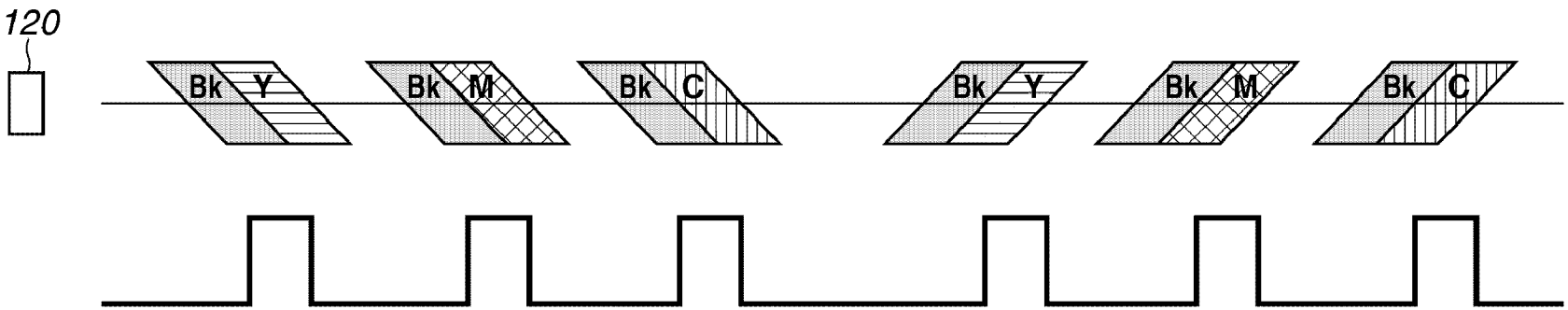
FIG. 13 is a diagram illustrating a detection waveform when a color misregistration amount detection pattern is detected.

FIG. 13 illustrates a detection waveform when the pattern illustrated in FIG. 11 is detected by the pattern detection sensor 120. The "LOW" level is indicated at the portions where the surface of the intermediate transfer member 103 and the black (Bk) developer are present, since the amount of the diffuse reflected light output from the light emitting unit of the pattern detection sensor 120 which is received by the light receiving unit is not enough to exceed the preset threshold. On the other hand, the "HIGH" level is indicated at the portions where the yellow (Y), magenta (M), and cyan (C) developers are present, since the amount of the diffuse reflected light output from the light emitting unit of the pattern detection sensor 120 which is received by the light receiving unit is enough to exceed the preset threshold. The conditions for determining the configuration of the color misregistration amount detection pattern formed on the endless intermediate transfer member 103 when the intermediate transfer member 103 is rasterized are the same as those in the first exemplary embodiment. More specifically, when, with a color misregistration amount detection pattern length of Pl for one set and the pattern interval of Pi, M sets of the color misregistration patterns are formed on the round length RL of the intermediate transfer member 103, if the conditions of, $$RL>(M-1)\times Pi+P1$$

$$Pi>P1$$

$$Pi=N/M$$

are satisfied, the color misregistration correction control for one time can be completed by rotating the intermediate transfer member 103 once.

Next, the method for detecting the color misregistration amount by using the color misregistration amount detection patterns of the present exemplary embodiment will be described.

The circuit configuration for detecting the color misregistration amount detection patterns can be the same as the configuration of FIG. 3 which was described for the first exemplary embodiment, and thus a description thereof is not repeated. Accordingly, the method for calculating the color misregistration amount from the results detected by the signal detection unit 212 will be now described.

Figure 14:
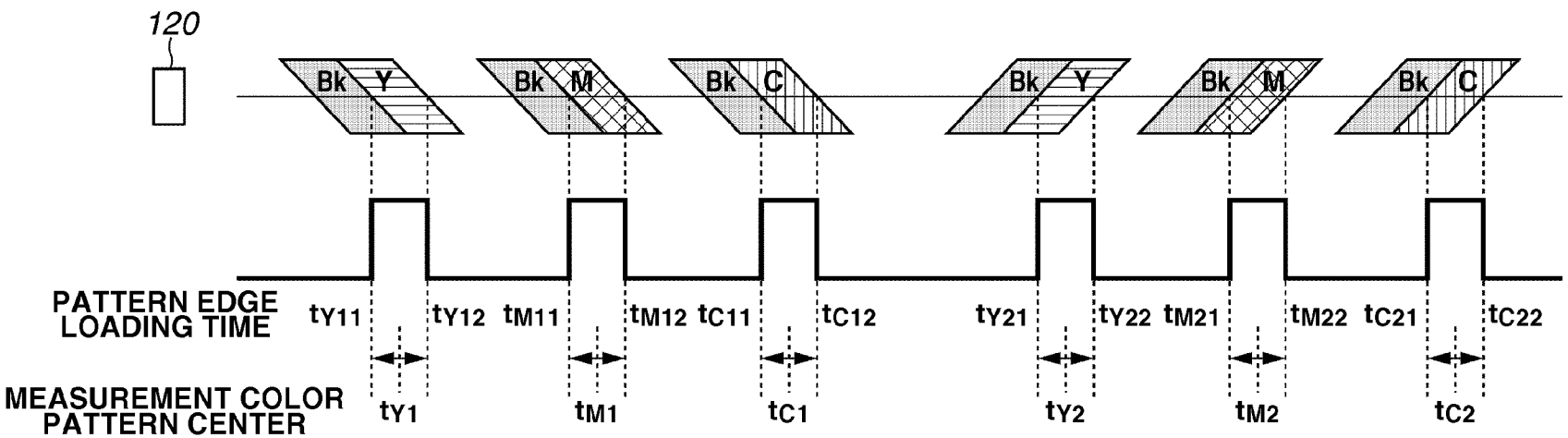
FIG. 14 is a diagram illustrating position detection of one set of color misregistration amount detection patterns.

In the method for calculating the color misregistration amount from the results detected by the signal detection unit 212, the misregistration amount is determined from an amount in which the reference color (Bk) pattern covers (superimposing) the measurement color (Y, M, or C) pattern. The method for calculating the color misregistration amount based on the amount of the measurement color covered by the reference color will be described based on FIG. 14. FIG. 14 illustrates an example of one set of the color misregistration amount detection patterns and the detection signal which is detected by the pattern detection sensor 120 and binarized by the comparator 211. When, as illustrated in FIG. 14, the times corresponding to the rising and falling of the detection signal in the yellow patterns are represented as $t_{Y11}$, $t_{Y12}$, $t_{Y21}$, and $t_{Y22}$, respectively, center positions $t_{Y1}$ and $t_{Y2}$ of the respective yellow patterns can be represented by the following expressions.

$$t_{Y1}=(t_{Y11}+t_{Y12})/2$$

$$t_{Y2}=(t_{Y21}+t_{Y22})/2$$

Therefore, the differences $\Delta t_{Y1}$ and $\Delta t_{Y2}$ between an ideal yellow pattern center position $P_{YW}$ and the measured center positions $t_{Y1}$ and $t_{Y2}$ of the yellow patterns can be represented by the following expressions. Here, the ideal yellow pattern center position $P_{YW}$ is the position from the $t_{Y11}$ of FIG. 14 to which half of what the originally appropriate distance (time) $(t_{Y12}-t_{Y11})$ is added.

$$\Delta t_{Y1}=t_{Y1}-P_{YW}$$

$$\Delta t_{Y2}=t_{Y2}-P_{YW}$$

The difference between the ideal pattern width and the actual pattern width is similarly determined for each measurement color, and the color misregistration amount which is the deviation amount in the relative positions between colors is calculated using the following expressions.

Color Misregistration in the Sub-scanning Direction

Sub-scanning color misregistration amount between $Bk$ and $Y=(\Delta t_{Y1}+\Delta t_{Y2})/2$ Sub-scanning color misregistration amount between $Bk$ and $M=(\Delta t_{M1}+\Delta t_{M2})/2$ Sub-scanning color misregistration amount between $Bk$ and $C=(\Delta t_{C1}+\Delta t_{C2})/2$ Color Misregistration in the Main Scanning Direction Main scanning color misregistration amount between $Bk$ and $Y=(\Delta t_{Y1}-\Delta t_{Y2})/2$ Main scanning color misregistration amount between $Bk$ and $M=(\Delta t_{M1}-\Delta t_{M2})/2$ Main scanning color misregistration amount between $Bk$ and $C=(\Delta t_{C1}-\Delta t_{C2})/2$ The color misregistration amounts of the write positions in the sub-scanning and main scanning are calculated by performing the above calculation for each pattern set, and determining the average for all of the sets. By taking the average of the pattern sets whose write timing phase deviates, the color misregistration amount resulting from rotation unevenness of the image carrier can be averaged.

Further, the total magnification color misregistration amount in the main scanning is calculated for each pattern set which is formed facing the left and right of the intermediate transfer member 103 illustrated in FIG. 7 based on the above main scanning color misregistration amounts.

Total Magnification Color Misregistration of n-th Set in the Main Scanning

The total magnification color misregistration amount between Bk and Y of n-th set=n-th Set (right) main scanning color misregistration amount between Bk and Y−n-th set (left) main scanning color misregistration amount between Bk and Y The total magnification color misregistration amount between Bk and M of n-th set=n-th Set (right) main scanning color misregistration amount between Bk and M−n-th set (left) main scanning color misregistration amount between Bk and M The total magnification color misregistration amount between Bk and C of n-th set=n-th Set (right) main scanning color misregistration amount between Bk and C−n-th set (left) main scanning color misregistration amount between Bk and C Here, the positive calculation result indicates that the writing of the measurement color start later than that of the reference color (the image width of the measurement color is wider than that of the reference color in terms of total magnification). On the other hand, the negative calculation result indicates that the writing of the measurement color start earlier than that of the reference color (the image width of the measurement color is narrower than that of the reference color in terms of total magnification). Further, like in the first exemplary embodiment, after executing the color misregistration correction control, the color image forming apparatus 100 adjusts the image forming condition based on the calculated color misregistration amount.

As described above, the color image forming apparatus which can efficiently receive the diffuse reflected light and perform the registration correction can be realized by using the color misregistration amount detection patterns illustrated in FIG. 11 while using the developer color having a small reflected component of the diffuse reflected light, such as black.

Further, it was learned from an experimental result that 9 sets of the color misregistration amount detection patterns illustrated in FIG. 11 are required to perform the registration correction with the same accuracy as the color misregistration amount detection patterns illustrated in FIG. 15. In this case, the same as in the first exemplary embodiment, when the width required for detecting the measurement color (assuming that the moving speed is of a certain speed) is given as l, and the width required for detecting black (Bk) is given as d, then, a length of (54 l+54 d) is required for the color misregistration amount detection patterns illustrated in FIG. 11. This length is, at least, shorter than (60 l+60 d) which is the length of 5 sets of the patterns of FIG. 15, namely, (12 l+12 d)×5. Thus, like in the first exemplary embodiment, the image carrier can be further miniaturized.

In the first exemplary embodiment and the second exemplary embodiment, the BD sensor 110 was only arranged on the scanning path of the black laser diode LD1, and was not present on the scanning paths of the other laser diodes. However, the present invention can be applied even in cases which include a laser beam detection unit for generating a horizontal synchronizing signal for the laser diodes of the respective colors in the color image forming apparatus. Even in such a case, the color image forming apparatus which can receive the diffuse reflected light and perform the registration correction can be realized while using the developer color having a small reflected component of the diffuse reflected light, such as black, for the reference color. Although black (Bk) was described as an example of the first developer whose position cannot be detected by the diffuse reflected light, the present invention may be applied to other colors, as long as such color is a developer whose position cannot be detected by the specific diffuse reflected light in the color image forming apparatus.

The present invention may be applied to a system configured from a plurality of devices, or applied in an apparatus configured from a single device. Examples thereof include a printer, a facsimile, a personal computer (PC), a computer system including a server and a client, and the like.

The present invention may also be achieved by directly or remotely supplying a software program for executing the various functions of the above-described exemplary embodiments, and having a computer included in the system etc. reading and executing the supplied program code.

Therefore, to realize the functional processing according to the present invention with a computer, the program code which is to be installed in the computer also realizes the present invention.

In such a case, the program may be of any form, such as an object code, a program executed by an interpreter, script data supplied to an operating system (OS) and the like, as long as it has the function of a program.

Examples of recording medium for supplying the program include floppy disks, hard disks, optical disks, magneto-optical disks (MO), a compact disk read only memory (CD-ROM), CD-recordable (CD-R), CD-rewritable (CD-RW), magnetic tapes, non-volatile memory, ROM, digital versatile disk (DVD) (DVD-ROM, DVD-R), and the like.

The program may be downloaded from an Internet website using a browser of a client computer. More specifically, the computer program itself according to the exemplary embodiments of the present invention, or a compressed file containing an auto-install function, may be downloaded from the website onto a recording medium, such as a hard disk. Further, the present invention can also be realized by dividing the program code constituting the program according to the exemplary embodiments of the present invention into a plurality of files, and downloading each of those files from different websites. Namely, a world wide web (WWW) server which allows a plurality of users to download the program files for realizing the functional processing of the exemplary embodiments according to the present invention by a computer is also included in the present invention.

The program according to the exemplary embodiments of the present invention may be distributed to a user by encrypting and storing the program on a recording medium such as a CD-ROM. In such case, only a user who satisfies certain conditions is allowed to download key information for decrypting from a website via the Internet, so that the program may be installed on a computer by decrypting and executing the program with that key information.

Further, the aforementioned functions of the exemplary embodiments can be realized by causing a computer to execute a read program. It is noted that the OS etc. running on the computer may perform all or a part of the actual processing based on an instruction from the program. The functions of the exemplary embodiments can be realized in such a case as well.

In addition, the exemplary embodiments may be realized by writing the program read from the recording medium into a memory which is provided on a function expansion board inserted into a computer or a function expansion unit connected to the computer. Based on an instruction from that program, a CPU etc. provided on that function expansion board or function expansion unit may perform all or a part of the actual processing. The functions of the exemplary embodiments can also be realized in this manner as well.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2007-245538 filed Sep. 21, 2007 and No. 2008-225813 filed Sep. 3, 2008, which are hereby incorporated by reference herein in its entirety.

What is claimed is:

1. A color image forming apparatus comprising:

a forming unit configured to form an image on an image carrier using a color developer and a black developer;

a controller configured to form on the image carrier a superimposed pattern by the forming unit in which a pattern of the black developer is superimposed on a pattern of the color developer as a background color;

a detector configured to irradiate the superimposed pattern with light and detect diffuse reflected light from a non-specular angle;

a calculator configured to determine a position of the pattern of the color developer and a position of the pattern of the black developer based on a detection result of the diffuse reflected light from the superimposed pattern by the detector and calculate a deviation amount in relative positions between the pattern of the color developer and the pattern of the black developer; and an adjustor configured to adjust an image forming condition based on a calculation result by the calculator.

2. The color image forming apparatus according to claim 1, wherein the calculator determines the position of the pattern of the color developer and the position of the pattern of the black developer based on the detection result of the diffuse reflected light from the pattern of the color developer included in the superimposed pattern.

3. The color image forming apparatus according to claim 1, wherein the calculator identifies the position of the pattern of the black developer based on a detection start and a detection finish of the color developer.

4. The color image forming apparatus according to claim 1, wherein the controller causes the forming unit to form the superimposed pattern in which the black developer is superimposed on the color developer as the background color so that one of the superimposed patterns passes the detector in order of the color developer, the black developer, and the color developer along a moving direction of the pattern.

5. The color image forming apparatus according to claim 1, wherein a width of the pattern of the color developer in the moving direction is longer than a width of the pattern of the black developer in the moving direction.

6. The color image forming apparatus according to claim 1, wherein black is used as a reference color for calculating the deviation amount in the relative positions.

7. A method for correcting color misregistration in a color image forming apparatus which comprises a forming unit configured to form an image on an image carrier using a color developer and a black developer, the method comprising:

forming on the image carrier a superimposed pattern by the forming unit in which a pattern of the black developer is superimposed on a pattern of the color developer as a background color;

causing a detector to irradiate the superimposed pattern with light and detect diffuse reflected light from a non-specular angle;

calculating a deviation amount in relative positions between the color developer and the black developer by determining the position of the pattern of the color developer and the position of the pattern of the black developer based on a detection result of the diffuse reflected light from the superimposed pattern; and adjusting an image forming condition based on a calculation result.

8. The method for correcting color misregistration according to claim 7, further comprising:

determining the position of the pattern of the color developer and the position of the pattern of the black developer based on the detection result of the diffuse reflected light from the pattern of the color developer included in the superimposed pattern.

9. The method for correcting color misregistration according to claim 7, further comprising:

identifying the position of the pattern of the black developer based on a detection start and a detection finish of the color developer.

10. The method for correcting color misregistration according to claim 7, further comprising:

forming the superimposed pattern in which the black developer is superimposed on the color developer as the background color so that one of the superimposed patterns passes the detector in order of the color developer, the black developer, and the color developer along a moving direction of the pattern.

11. The method for correcting color misregistration according to claim 7, wherein a width of the pattern of the color developer in a moving direction is longer than a width of the pattern of the black developer in a moving direction.

12. The method for correcting color misregistration according to claim 7, wherein black is used as a reference color for calculating the deviation amount in the relative positions.

* * * * *